US008863645B2

(12) United States Patent
Andersen et al.

(10) Patent No.: US 8,863,645 B2
(45) Date of Patent: Oct. 21, 2014

(54) PISTON SUPPORT PORTION FOR A PISTON ASSEMBLY OF A RODLESS CYLINDER

(75) Inventors: Michael Andersen, Krefeld (DE); Martin Engels, Alpen (DE); Gerhard Bohmer, Wesel (DE)

(73) Assignee: Norgren GmbH, Alpen (DE)

( * ) Notice: Subject to any disclaimer, the term of this patent is extended or adjusted under 35 U.S.C. 154(b) by 1177 days.

(21) Appl. No.: 12/531,176

(22) PCT Filed: Mar. 28, 2007

(86) PCT No.: PCT/EP2007/002728

§ 371 (c)(1),
(2), (4) Date: Sep. 14, 2009

(87) PCT Pub. No.: WO2008/116487

PCT Pub. Date: Oct. 2, 2008

(65) Prior Publication Data

US 2010/0083825 A1 Apr. 8, 2010

(51) Int. Cl.

| | |
|---|---|
| ***F01B 29/00*** | (2006.01) |
| ***F15B 15/08*** | (2006.01) |
| ***F15B 15/14*** | (2006.01) |

(52) U.S. Cl.

CPC ..... *F15B 15/082* (2013.01); *F15B 15/1471* (2013.01)

USPC ..... 92/88

(58) Field of Classification Search

CPC .... F15B 15/082; F15B 15/084; F15B 15/086; F15B 15/1471; F16C 29/08

USPC ..... 92/88, 137, 175, 177, 192, 255; 277/345

See application file for complete search history.

(56) References Cited

U.S. PATENT DOCUMENTS

| | | | | | |
|---|---|---|---|---|---|
| 3,155,015 | A | * | 11/1964 | Genz | 92/249 |
| 3,447,427 | A | * | 6/1969 | Mickle | 92/253 |
| 3,457,842 | A | * | 7/1969 | Tennis | 92/200 |
| 4,373,427 | A | * | 2/1983 | Garlapaty et al. | 92/88 |
| 4,545,290 | A | * | 10/1985 | Lieberman | 92/88 |
| 4,555,980 | A | | 12/1985 | Hoglund | |
| 4,852,465 | A | | 8/1989 | Rosengren | |
| RE33,637 | E | * | 7/1991 | Hoglund | 92/88 |
| 5,279,207 | A | * | 1/1994 | Takada et al. | 92/5 R |
| 5,311,810 | A | * | 5/1994 | Takada et al. | 92/88 |
| 5,317,957 | A | | 6/1994 | Miyamoto | |
| 5,333,535 | A | * | 8/1994 | Miyamoto et al. | 92/88 |

(Continued)

FOREIGN PATENT DOCUMENTS

| | | |
|---|---|---|
| EP | 0522271 A1 | 1/1993 |
| JP | 2002323006 A | 11/2002 |

*Primary Examiner* — Edward Look
*Assistant Examiner* — Michael Quandt
(74) *Attorney, Agent, or Firm* — The Ollila Law Group LLC

(57) ABSTRACT

A piston support portion (146) for a piston assembly (140) of a rodless cylinder (100) is provided according to the invention. The piston support portion (146) includes a support body (147) substantially matching a shape of the piston assembly (140) and configured to be positioned between a piston center portion (126) and a piston end portion (160). The piston support portion (146) further includes a plurality of guidance portions (152) extending from a circumference of the support body (147). The plurality of guidance portions (152) are configured to contact or nearly contact a piston bore (107) of the rodless cylinder (100) and guide the piston assembly (140) as it reciprocates in the piston bore (107).

22 Claims, 7 Drawing Sheets

(56) References Cited

U.S. PATENT DOCUMENTS

| | | | | | |
|---|---|---|---|---|---|
| 5,531,151 | A | * | 7/1996 | Matsui | 92/88 |
| 5,555,789 | A | * | 9/1996 | Rosengren et al. | 92/165 R |
| 5,619,899 | A | * | 4/1997 | Asai et al. | 92/88 |
| 5,974,947 | A | * | 11/1999 | Noda | 92/88 |
| 5,988,042 | A | * | 11/1999 | Lamle | 92/88 |
| 5,996,469 | A | * | 12/1999 | Green | 92/88 |
| 6,007,247 | A | * | 12/1999 | Rosengren et al. | 384/41 |
| 6,109,166 | A | * | 8/2000 | Granberg | 92/88 |
| 6,253,660 | B1 | * | 7/2001 | Noda et al. | 92/88 |
| 6,308,821 | B1 | * | 10/2001 | Asai et al. | 198/750.7 |
| 6,336,393 | B1 | | 1/2002 | LeMire et al. | |
| 6,425,315 | B1 | | 7/2002 | Kaneko et al. | |
| 6,481,334 | B1 | | 11/2002 | Kaneko | |
| 6,584,887 | B1 | * | 7/2003 | Poeschl | 92/88 |
| 6,694,865 | B2 | * | 2/2004 | Kaneko et al. | 92/88 |
| 7,318,422 | B2 | * | 1/2008 | Douyama et al. | 123/495 |
| 7,448,311 | B2 | * | 11/2008 | Naruse et al. | 92/88 |

* cited by examiner

SECTION AA

PISTON SUPPORT PORTION FOR A PISTON ASSEMBLY OF A RODLESS CYLINDER

BACKGROUND OF THE INVENTION

1. Field of the Invention

The invention is related to the field of rodless cylinders, and in particular, to a piston support portion for a piston assembly of a rodless cylinder.

2. Statement of the Problem

Actuators come in many styles and shapes. One type of activator is a rodless cylinder, for example a Lintra® Rodless cylinder M/46000 from Norgren. Rodless cylinders differ from basic cylinders in that no piston rod extends outside the cylinder body. Instead, an internal piston is connected to an external carriage by a mechanical coupling system.

Rodless cylinders are ideal for long stroke applications because they are unaffected by rod overhang, bending, piston binding, and uneven seal wear. Rodless cylinders can advantageously be used in confined areas where space is at a premium. Rodless cylinders do no require clearance of at least double their body length, as do rod-type cylinders or actuators.

Unfortunately, the rodless cylinder design necessitates a long sealing strip running the length of the rodless cylinder. The sealing strip is typically used to seal the pneumatic chamber of the rodless cylinder. The piston assembly of the rodless cylinder therefore includes devices to unseal the sealing strip in the direction of travel and to reseal the sealing strip behind the carriage as it moves.

SUMMARY OF THE INVENTION

A piston support portion for a piston assembly of a rodless cylinder is provided according to the invention. The piston support portion includes a support body substantially matching a shape of the piston assembly and configured to be positioned between a piston center portion and a piston end portion. The piston support portion further includes a plurality of guidance portions extending from a circumference of the support body. The plurality of guidance portions are configured to contact or nearly contact a piston bore of the rodless cylinder and guide the piston assembly as it reciprocates in the piston bore.

A piston support portion for a piston assembly of a rodless cylinder is provided according to the invention. The piston support portion includes a support body substantially matching a shape of the piston assembly and configured to be positioned between a piston center portion and a piston end portion. The piston support portion further includes a sealing strip divider extending from the support body and adapted to extend through a sealing strip of the rodless cylinder. The sealing strip divider is configured to separate a first seal portion and a second seal portion of the sealing strip.

A piston support portion for a piston assembly of a rodless cylinder is provided according to the invention. The piston support portion includes a support body substantially matching a shape of the piston assembly and configured to be positioned between a piston center portion and a piston end portion. The piston support portion further includes a plurality of guidance portions extending from a circumference of the support body. The plurality of guidance portions are configured to contact or nearly contact a piston bore of the rodless cylinder and guide the piston assembly as it reciprocates in the piston bore. The piston support portion further includes a sealing strip divider extending from the piston support portion and adapted to extend through a sealing strip of the rodless cylinder. The sealing strip divider is configured to separate a first seal portion and a second seal portion of the sealing strip.

ASPECTS OF THE INVENTION

In one aspect of the invention, the support body includes a substantially tubular portion designed to fit over the piston center portion.

In another aspect of the invention, the support body includes a substantially tubular portion designed to fit over the piston center portion and a lip extending substantially radially inward.

In yet another aspect of the invention, a guidance portion of the plurality of guidance portions comprises a plurality of sidewalls extending from the support body and a contact surface formed on the plurality of sidewalls and positioned substantially parallel to an interior surface of the piston bore.

In yet another aspect of the invention, the contact surface comprises a low friction material.

In yet another aspect of the invention, the contact surface is at least partially coated with a low friction material.

In yet another aspect of the invention, the rodless cylinder further comprises a sealing strip divider extending from the piston support portion and adapted to extend through a sealing strip of the rodless cylinder, with the sealing strip divider being configured to separate a first seal portion and a second seal portion of the sealing strip.

In yet another aspect of the invention, the sealing strip divider comprises an upper trough for receiving one or more extending portions of the first seal portion and a pair of upper rails positioned on either side of the upper trough.

In yet another aspect of the invention, the sealing strip divider comprises a lower trough for receiving one or more extending portions of the second seal portion and a pair of lower rails positioned on either side of the lower trough.

In yet another aspect of the invention, the rodless cylinder further comprises a plurality of guidance portions extending from a circumference of the support body, with the plurality of guidance portions being configured to contact or nearly contact a piston bore of the rodless cylinder and guide the piston assembly as it reciprocates in the piston bore.

DESCRIPTION OF THE DRAWINGS

The same reference number represents the same element on all drawings. It should be understood that the drawings are not necessarily to scale.

DETAILED DESCRIPTION OF THE INVENTION

FIGS. 1-7 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
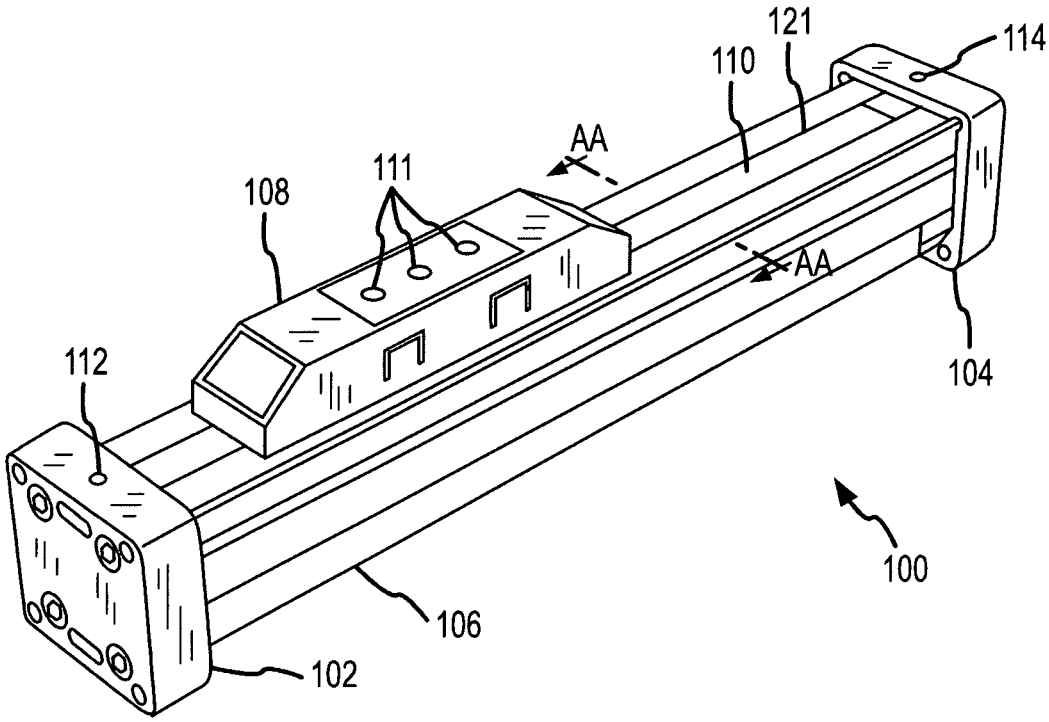
FIG. 1 shows a rodless cylinder according to an embodiment of the invention.

FIG. 1 shows a rodless cylinder 100 according to an embodiment of the invention. The rodless cylinder 100 includes end caps 102 and 104, a cylinder body 106, a carriage 108, a sealing strip 110, and two or more ports 112 and 114. Not visible in this figure is a piston assembly 140 configured to reciprocate in a piston bore 107 formed in the cylinder body 106. The carriage 108 is attached to and moves with the piston assembly 140.

In operation, fluid can be added to or removed from the rodless cylinder 100 via the ports 112 or 114, moving the carriage 108 in a reciprocating manner between the end caps 102 and 104. Alternatively, if the carriage 108 is forced to move, then fluid can be drawn into and expelled from the ports 112 and 114 by movement of the piston assembly 140.

The carriage 108 can include one or more attachment features 111. The one or more attachment features 111 allow the carriage 108 to convert a fluid energy to a mechanical energy by moving the carriage 108. Alternatively, the carriage 108 can receive mechanical energy and convert it to fluid energy.

Figure 2:
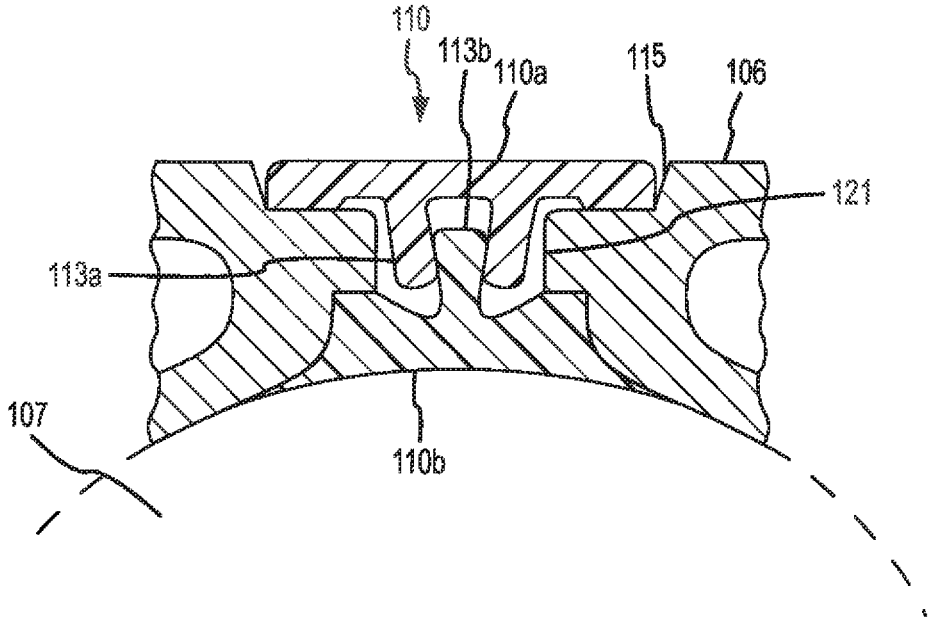
FIG. 2 is a section view AA of the rodless cylinder showing detail of a sealing strip according to an embodiment of the invention.

The sealing strip 110 comprises a first seal portion 110*a* and a second seal portion 110*b* (see FIG. 2). The first seal portion 110*a* and the second seal portion 110*b* can be sealingly joined to seal a lengthwise slot 121 in the cylinder body 106. Conversely, the first seal portion 110*a* and the second seal portion 110*b* can be moved apart to at least partially open the slot 121. For example, the two seal portions can be moved apart to allow the reciprocal motion of a piston yoke 127 (see FIG. 3 and the accompanying discussion below). The piston yoke 127 can connect the carriage 108 to the piston assembly 140 inside the cylinder body 106.

In operation, the carriage 108 can move reciprocally between the two end caps 102 and 104 as fluid is forced into the port 112 in the end cap 102 or into port 114 in the end cap 104, driving the piston assembly 140, as previously discussed. As the carriage 108 moves towards one end of the rodless cylinder 100, the leading end of the carriage 108 forces the first seal portion 110*a* upward and away from the second seal portion 110*b* while simultaneously forcing the second seal portion 110*b* downward. To this end, the leading end of the carriage 108 comprises a sealing strip divider 148 (see FIG. 3). As the carriage 108 passes by, the trailing end of the carriage 108 forces the first seal portion 110*b* back downward and into sealing engagement with the second seal portion 110*b* and into a sealed configuration in the slot 121.

FIG. 2 is a section view AA of the rodless cylinder 100 showing detail of the sealing strip 110 according to an embodiment of the invention. The figure shows the slot 121 in the cylinder body 106. The slot 121 opens to the piston bore 107 formed in the cylinder body 106. The sealing strip 110 fits into the slot 121 and can be sealingly engaged in order to substantially seal the slot 121. The piston bore 107, when the slot 121 is sealed, forms a pneumatic chamber that receives the piston assembly 140.

It can be seen from the figure that the sealing strip 110 comprises a first seal portion 110*a* and a second seal portion 110*b*. Both the first seal portion 110*a* and the second seal portion 110*b* reside in the slot 121. The first seal portion 110*a* and the second seal portion 110*b* can be sealingly engaged, as shown in the figure. When they are sealingly engaged, the first seal portion 110*a* and the second seal portion 110*b* prevent fluid from passing through the slot 121.

The first seal portion 110*a* is received in a depression 115 formed in the cylinder body 106. In some embodiments, the first seal portion 110*a* is substantially flush with the exterior surface of the cylinder body 106, as shown. In addition, the first seal portion 110*a* includes one or more extending portions 113*a* and likewise the second seal portion 110*b* includes one or more corresponding extending portions 113*b*. The extending portions 113*a* and 113*b* can mesh and can therefore sealingly engage.

Figure 3:
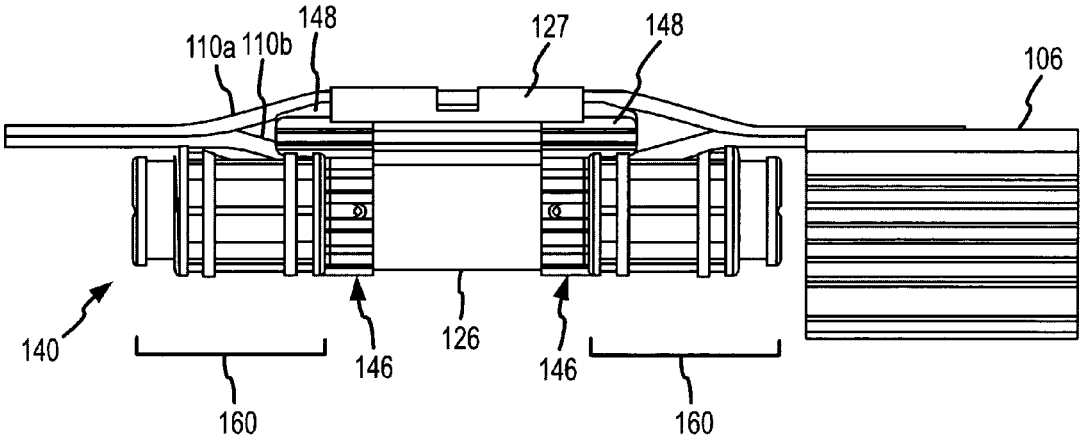
FIG. 3 is a partial section view of the rodless cylinder showing detail of a piston assembly according to an embodiment of the invention.

FIG. 3 is a partial section view of the rodless cylinder 100 showing detail of the piston assembly 140 according to an embodiment of the invention. The figure shows a portion of the cylinder body 106 and includes a cut-away portion that shows detail of the piston assembly 140 and the sealing strip 110. The sealing strip 110 accommodates a piston yoke 127 that passes between the first seal portion 110*a* and the second seal portion 110*b*. The carriage 108 can be attached to the piston yoke 127.

The piston yoke 127 extends through the slot 121 in the cylinder body 106. The piston yoke 127 therefore connects the carriage 108 to the piston assembly 140. The piston yoke 127 further performs a dividing function for the sealing strip 110. In the figure, as the piston yoke 127 moves to the right, it will lift and divide the first seal portion 110*a* from the second seal portion 110*b*. To this end, the piston yoke 127 includes sealing strip dividers 148 of the piston support portions 146. A trailing portion of the carriage 108 rejoins the first seal portion 110*a* and the second seal portion 110*b* behind the carriage 108 as it moves, on the left in this example.

The piston assembly 140 in the embodiment shown includes a piston center portion 126, a pair of piston end portions 160, and a pair of piston support portions 146. The piston end portions 160 can include one or more seals (not shown) or sealing members.

The piston center portion 126 is connected to the piston yoke 127. The piston end portions 160 are affixed to the piston center portion 126. Each piston support portion 146 is positioned between a piston end portion 160 and the piston center portion 126. The piston support portions 146 combine a sealing strip dividing function and a guidance function, as previously discussed.

The piston support portions 146 include sealing strip dividers 148 that join to the piston yoke 127. The two sealing strip dividers 148 provide additional support and rigidity to the piston yoke 127. For example, the sealing strip dividers 148 can include slots that receive corresponding portions of the piston yoke 127 (see FIGS. 4-6 and the accompanying discussion).

When the piston assembly 140 is assembled, the two piston support portions 146 are spaced apart and separated by the piston center portion 126. The two piston support portions 146 are configured to move and guide the piston assembly 140 within the piston bore 107. In addition, the construction of the piston assembly 140 provides strength and rigidity.

The two piston support portions 146 can be bonded to the piston center portion 126 and the piston yoke 127 by any manner of bonding agent or adhesive. Alternatively, the two piston support portions 146 can be attached to the piston center portion 126 by snaps, clips, resilient portions, fasteners, etc.

The piston support portions 146 can contact the interior surface of the piston bore 107 and can guide and stabilize the piston assembly 140 during reciprocal motion. To that end, the piston support portions 146 can include a plurality of guidance portions 152 (see FIGS. 4-6 and the accompanying discussion). The guidance portions 152 are configured to be positioned adjacent to the interior surface of the piston bore 107 and are configured to be near to or in contact with the interior surface. The guidance portions 152 of a piston support portion 146 do not allow the piston support portion 146 to move significantly non-axially in the piston bore 107. The guidance portions 152 are configured to provide a predetermined amount of clearance within the piston bore 107. The guidance portions 152 are configured to keep the one or more seals of a piston end portion 160 in a proper position. The guidance portions 152 are configured to prevent excessive wear of the seals. The guidance portions 152 are configured to provide a low sliding friction.

The two spaced apart piston support portions 146 provide stability to the piston assembly 140. The two spaced apart piston support portions 146 prevent the piston assembly 140 from wobbling or rotating about a longitudinal axis.

The piston support portions 146 offer a low gliding resistance. The piston support portions 146 maintain an even sealing contact between the piston assembly 140 and the piston bore 107.

Figure 4:
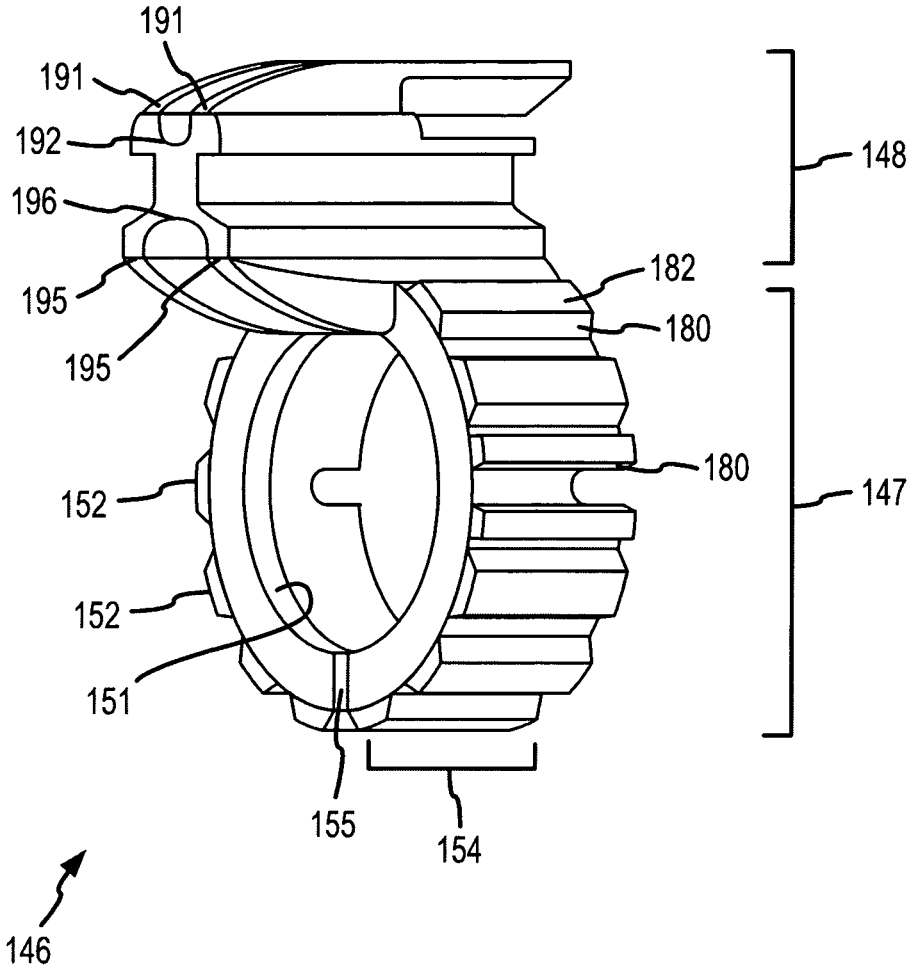
FIGS. 4-6 show a piston support portion according to an embodiment of the invention.
Figure 5:
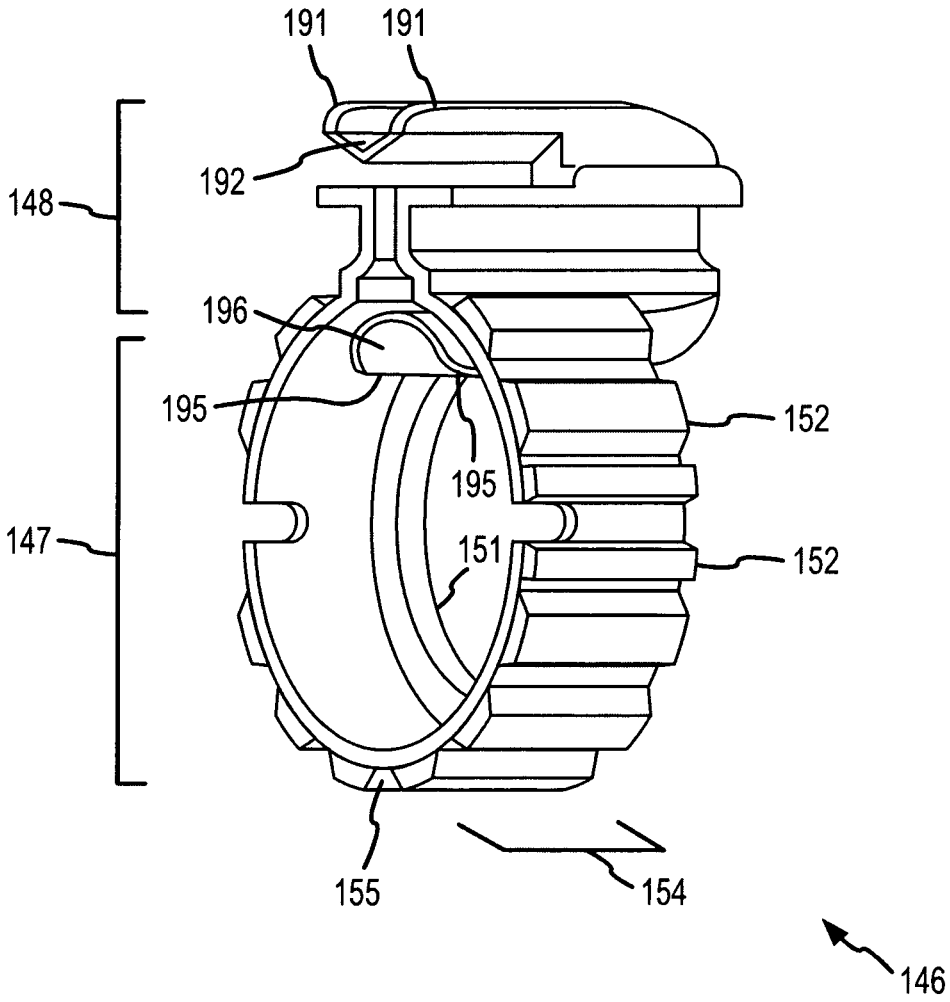
Figure 6:
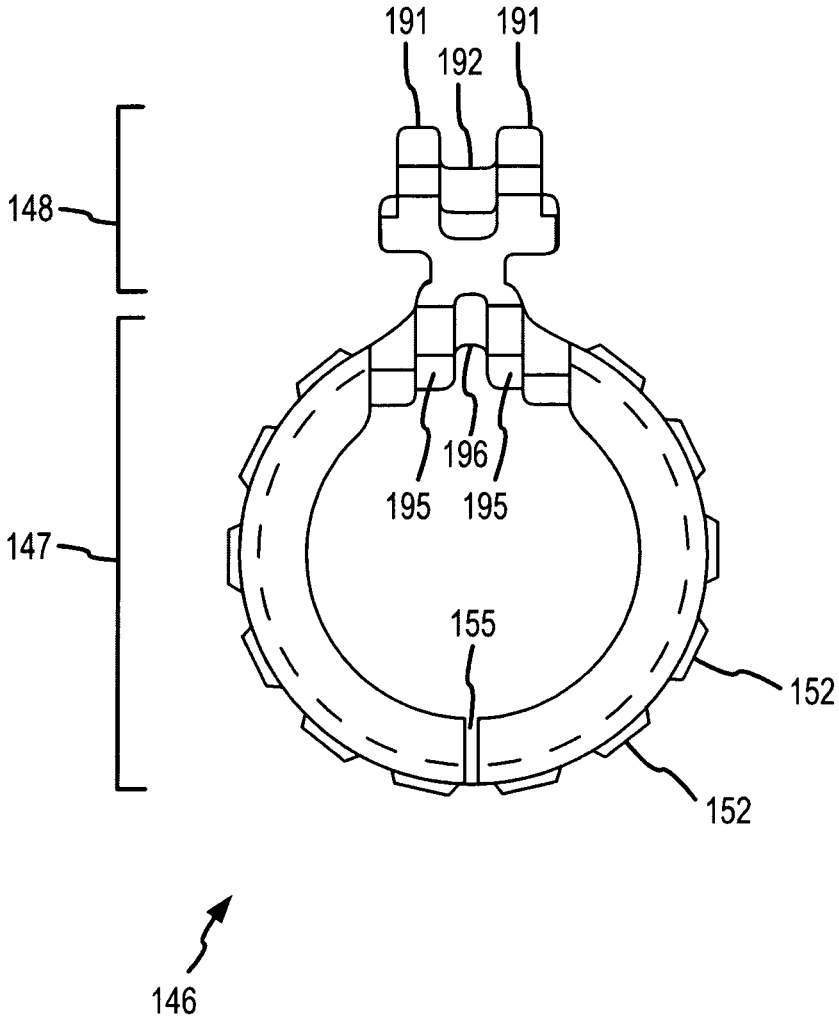

FIGS. 4-6 show the piston support portion 146 according to an embodiment of the invention. The piston support portion 146 includes a support body 147 and a sealing strip divider 148.

The support body 147 is positioned between and can be affixed to the piston center portion 126 and a piston end portion 160. The support body 147 therefore becomes part of the piston assembly 140, as previously discussed. The support body 147 can include a tubular portion 154, a lip 151, and a plurality of guidance portions 152.

The tubular portion 154 in one embodiment substantially conforms to the shape of the piston bore 107. However, in other embodiments the tubular portion 154 can deviate from the shape of the piston bore 107, wherein the plurality of guidance portions 152 in such an embodiment can substantially conform to the shape of the piston bore 107.

The lip 151 can extend substantially radially inward from the tubular portion 154. The lip 151 can be received between the piston center portion 126 and a piston end portion 160. In some embodiments, the lip 151 can be clamped between the piston center portion 126 and a piston end portion 160. In the embodiment shown, the lip 151 does not extend fully radially inward. However, in some embodiments the lip 151 can extend fully radially inward.

The plurality of guidance portions 152 include sidewalls 180 and a contact surface 182 formed on the sidewalls 180. The contact surface 182 is configured to contact the interior surface of the piston bore 107. A guidance portion 152 can be as tall as needed in order to place the contact surface 182 in a predetermined position and according to a predetermined clearance. Consequently, the contact surfaces 182 of all of the plurality of guidance portions 152 are positioned in contact with or nearly in contact with the interior surface of the piston bore 107. It should be understood that the guidance portions 152 do not have to be uniform in height, and can be various heights as needed to match the interior surface of the piston bore 107.

In some embodiments, the piston support portion 146 can be formed of a low friction material, such as a low friction plastic. One widely used low friction material is polytetrafluoroethylene (PTFE), also known under the trademark of TEFLON. Other low friction materials are contemplated and are within the scope of the description and claims. Alternatively, a contact surface 182 can be at least partially coated with a low friction material.

The tubular body 154 in some embodiments includes a gap 155. The gap 155 can allow the support body 147 to compress at least somewhat. The piston support portion 146 can be at least partially flexible, wherein the piston support portion 146 can be under at least some compression in the piston bore 107.

The sealing strip divider 148 extends from the support body 147. The sealing strip divider 148 extends through the slot 121. The sealing strip divider 148 can form a portion of the piston yoke 127. The sealing strip divider 148 can include two upper rails 191 separated by an upper trough 192 and can include two lower rails 195 separated by a lower trough 196. Both the upper and lower rails 191 and 195 can include angled or curved portions that function to separate the two portions of the sealing strip 110. The upper and lower troughs 192 and 196 can receive extending portions of the first seal portion 110*a* and the second seal portion 110*b*. The upper trough 192 can be of a different size than the lower trough 196 if needed, such as wider than the lower trough 196, for example.

Figure 7:
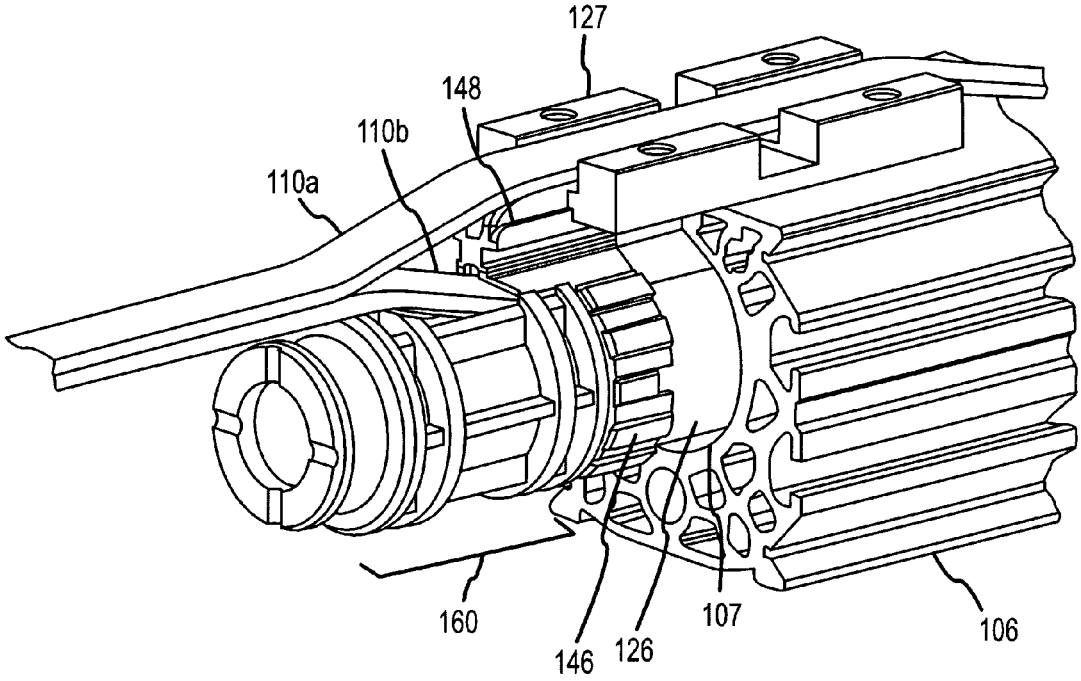
FIG. 7 is a partial section view of the rodless cylinder, showing the piston assembly fitted to a piston bore.

FIG. 7 is a partial section view of the rodless cylinder 100, showing the piston assembly 140 fitted to the piston bore 107. The figure further shows the sealing strip divider 148 and the piston yoke 127.

This figure illustrates the guiding function of the piston support portion 146. It can be seen from this figure that the guide portions 152 can contact the interior surface of the piston bore 107 and can therefore guide the piston assembly 140 during reciprocal movement in the piston bore 107. Further, the piston support portions 146 contact the piston bore 107 at two spaced apart locations, providing greater stability to the piston assembly 140. The piston support portions 146 prevent vibration, rotation, or wobbling of the piston assembly 140.

This figure further illustrates the sealing strip dividing function of the piston support portion 146. It can be seen from the figure that as the piston assembly 140 moves to the left, the sealing strip divider 148 spreads apart the first sealing portion 110*a* and the second sealing portion 110*b*. The two upper rails 191 function to lift the first seal portion 110*a* up and over the piston yoke 127. The one or more extending portions 113*a* of the first seal portion 110*a* are received in and are guided over the piston yoke 127 by the upper trough 192. The two lower rails 195 function to push the second seal portion 110*b* down and under the piston yoke 127. The one or more extending portions 113*b* of the second seal portion 110*b* are received in and are guided under the piston yoke 127 by the lower trough 196.

The piston support portion 146 combines a guiding function and a sealing strip dividing function in one component. The piston support portion 146 can reduce the overall number of parts required for the piston assembly 140. The piston support portion 146 offers low cost due to the ability to employ injection moulding production and plastic, among other materials.

The piston support portion 146 improves guidance of the piston assembly 140 in the piston bore 107. The piston support portion 146 ensures that rotational moments and piston guidance are not transferred to the piston end portions 160 and to the piston seals. The piston support portion 146 prevents scoring occurring on either the piston bore 107 or the piston center portion 126. The piston support portion 146 ensures that there is less wear on the piston seals.

The piston support portion 146 reduces a clearance needed by the piston assembly 140. The piston support portion 146 increases durability of the rodless cylinder 100. The piston support portion 146 enables the piston assembly 140 and therefore the rodless cylinder 100 to carry higher loads.

What is claimed is:

1. A rodless cylinder (100) comprising a piston assembly (140) and a piston support portion (146), with the piston support portion (146) being a single component of unitary construction characterized by:

a support body (147) substantially matching a shape of the piston assembly (140) and configured to be positioned between a piston center portion (126) and a piston end portion (160);

a plurality of guidance portions (152) extending from a circumference of the support body (147), with the plurality of guidance portions (152) being configured to contact a piston bore (107) of the rodless cylinder (100) and guide the piston assembly (140) as it reciprocates in the piston bore (107); and a sealing strip divider (148) extending from the support body (147) and adapted to extend through a slot (121) and through a sealing strip (110) of the rodless cylinder (100), with the sealing strip divider (148) being configured to separate a first seal portion and a second seal portion of the sealing strip (110).

2. The rodless cylinder (100) of claim 1, with the support body (147) including a substantially tubular portion (154) designed to fit over the piston center portion (126).

3. The rodless cylinder (100) of claim 1, with the support body (147) including a substantially tubular portion (154) designed to fit over the piston center portion (126) and a lip (151) extending substantially radially inward.

4. The rodless cylinder (100) of claim 1, with a guidance portion (152) of the plurality of guidance portions (152) comprising:

a plurality of sidewalls (180) extending from the support body (147); and a contact surface (182) formed on the plurality of sidewalls (180), with the contact surface (182) positioned substantially parallel to an interior surface of the piston bore (107).

5. The rodless cylinder (100) of claim 4, with the contact surface (182) comprising a low friction material.

6. The rodless cylinder (100) of claim 4, with the contact surface (182) being at least partially coated with a low friction material.

7. The rodless cylinder (100) of claim 1, with the sealing strip divider (148) comprising:

an upper trough (192) for receiving one or more extending portions (113*a*) of the first seal portion (110*a*); and a pair of upper rails (191) positioned on either side of the upper trough (192).

8. The rodless cylinder (100) of claim 1, with the sealing strip divider (148) comprising:

a lower trough (196) for receiving one or more extending portions (113*b*) of the second seal portion (110*b*); and a pair of lower rails (195) positioned on either side of the lower trough (196).

9. A rodless cylinder (100) comprising a piston assembly (140) and a piston support portion (146), with the piston support portion (146) being a single component of unitary construction characterized by:

a support body (147) substantially matching a shape of the piston assembly (140) and configured to be positioned between a piston center portion (126) and a piston end portion (160);

a plurality of guidance portions (152) extending from a circumference of the support body (147), with the plurality of guidance portions (152) being configured to contact a piston bore (107) of the rodless cylinder (100) and guide the piston assembly (140) as it reciprocates in the piston bore (107);

a sealing strip divider (148) extending from the support body (147) and adapted to extend through a sealing strip (110) of the rodless cylinder (100), with the sealing strip divider (148) being configured to separate a first seal portion and a second seal portion of the sealing strip (110), the sealing strip divider (148) including:

a lower trough (196) for receiving one or more extending portions (113*b*) of the second seal portion (110*b*); and a pair of lower rails (195) positioned on either side of the lower trough (196).

10. The rodless cylinder (100) of claim 9, with the support body (147) including a substantially tubular portion (154) designed to fit over the piston center portion (126).

11. The rodless cylinder (100) of claim 9, with the support body (147) including a substantially tubular portion (154) designed to fit over the piston center portion (126) and a lip (151) extending substantially radially inward.

12. The rodless cylinder (100) of claim 9, with a guidance portion (152) of the plurality of guidance portions (152) comprising:

a plurality of sidewalls (180) extending from the support body (147); and a contact surface (182) formed on the plurality of sidewalls (180), with the contact surface (182) positioned substantially parallel to an interior surface of the piston bore (107).

13. The rodless cylinder (100) of claim 12, with the contact surface (182) comprising a low friction material.

14. The rodless cylinder (100) of claim 12, with the contact surface (182) being at least partially coated with a low friction material.

15. The rodless cylinder (100) of claim 9, with the sealing strip divider (148) comprising:

an upper trough (192) for receiving one or more extending portions (113*a*) of the first seal portion (110*a*); and a pair of upper rails (191) positioned on either side of the upper trough (192).

16. A rodless cylinder (100) comprising a piston assembly (140) and a piston support portion (146), with the piston support portion (146) being a single component of unitary construction characterized by:

a support body (147) substantially matching a shape of the piston assembly (140) and configured to be positioned between a piston center portion (126) and a piston end portion (160);

a plurality of guidance portions (152) extending from a circumference of the support body (147), with the plurality of guidance portions (152) being configured to contact a piston bore (107) of the rodless cylinder (100) and guide the piston assembly (140) as it reciprocates in the piston bore (107), with a guidance portion (152) of the plurality of guidance portions (152) comprising:

a plurality of sidewalls (180) extending from the support body (147); and a contact surface (182) formed on the plurality of sidewalls (180) and positioned substantially parallel to an interior surface of the piston bore (107); and a sealing strip divider (148) extending from the support body (147) and adapted to extend through a sealing strip (110) of the rodless cylinder (100), with the sealing strip divider (148) being configured to separate a first seal portion and a second seal portion of the sealing strip (110).

17. The rodless cylinder (100) of claim 16, with the support body (147) including a substantially tubular portion (154) designed to fit over the piston center portion (126).

18. The rodless cylinder (100) of claim 16, with the support body (147) including a substantially tubular portion (154) designed to fit over the piston center portion (126) and a lip (151) extending substantially radially inward.

19. The rodless cylinder (100) of claim 16, with the contact surface (182) comprising a low friction material.

20. The rodless cylinder (100) of claim 16, with the contact surface (182) being at least partially coated with a low friction material.

21. The rodless cylinder (100) of claim 16, with the sealing strip divider (148) comprising:

an upper trough (192) for receiving one or more extending portions (113*a*) of the first seal portion (110*a*); and a pair of upper rails (191) positioned on either side of the upper trough (192).

22. The rodless cylinder (100) of claim 16, with the sealing strip divider (148) comprising:

a lower trough (196) for receiving one or more extending portions (113*b*) of the second seal portion (110*b*); and a pair of lower rails (195) positioned on either side of the lower trough (196).

* * * * *